US006826871B2

(12) United States Patent
Morton et al.

(10) Patent No.: US 6,826,871 B2
(45) Date of Patent: Dec. 7, 2004

(54) DOUBLE OR SINGLE HUNG WINDOW UNIT HAVING PLASTIC FRAME MEMBERS WITH WINDLOAD RESISTANCE

(75) Inventors: Philip G. Morton, Germantown, OH (US); Michael T. Chaney, Middletown, OH (US)

(73) Assignee: Dayton Technologies, L.L.C., Monroe, OH (US)

( * ) Notice: Subject to any disclaimer, the term of this patent is extended or adjusted under 35 U.S.C. 154(b) by 0 days.

(21) Appl. No.: 10/348,245

(22) Filed: Jan. 21, 2003

(65) Prior Publication Data

US 2004/0139655 A1 Jul. 22, 2004

(51) Int. Cl.[7] ..... E06B 1/04
(52) U.S. Cl. ..... 49/504
(58) Field of Search ..... 52/204.5; 49/163, 49/404, 406, 504, DIG. 1

(56) References Cited

U.S. PATENT DOCUMENTS 4,106,239 A * 8/1978 Bancroft et al. ..... 49/449
4,941,288 A 7/1990 Morton
6,055,782 A * 5/2000 Morton et al. ..... 52/204.1
6,330,769 B1 * 12/2001 Manzella et al. ..... 52/204.62

* cited by examiner

*Primary Examiner*—Jerry Redman
(74) *Attorney, Agent, or Firm*—Jacox, Meckstroth & Jenkins

(57) ABSTRACT

A double or single hung window assembly includes a rectangular main frame formed by a pair of vertical jamb members rigidly connected by a horizontal sill member and a horizontal head member, and each of the members comprises an extrusion of rigid plastics material. The frame members have outer walls for the rough window opening and laterally spaced inner sloping walls, and the inner and outer walls mate at mitered welded corner joints. The jamb members also have inner channel walls for receiving sliding hardware for at least one sash frame formed of extrusions of rigid plastics material. The inner sloping wall of the sill member has an upwardly projecting integral rib which cooperates with a downwardly projecting stop member or rib on the bottom of the sash frame to limit deflection of the sash frame under high negative windloads.

13 Claims, 2 Drawing Sheets

DOUBLE OR SINGLE HUNG WINDOW UNIT HAVING PLASTIC FRAME MEMBERS WITH WINDLOAD RESISTANCE

BACKGROUND OF THE INVENTION

This invention relates to a double hung or single hung window assembly fabricated or constructed from extrusions of rigid plastics material such as rigid polyvinylchloride, and of the general type disclosed in U.S. Pat. No. 6,055,782 which issued to the assignee of the present invention. In such an assembly, it is desirable for the assembly to withstand high negative windloads which occur, for example, during a hurricane or tornado, and which tend to pull the fabricated sash frame and glass assembly of each window unit out of the fabricated main frame assembly. With such windloads, the lower or bottom horizontal sash rail of the inner or lower window unit is especially subjected to substantial deflection or bowing which can cause damage or breakage to the sash frame and glass assembly of the window unit. When the bottom sash rail of the lower window unit seats within a horizontal channel in the sill member, the channel prevents deflection of the bottom sash rail. However, with a sloping sill member which does not have a channel, there is nothing to resist bending or bowing of the bottom sash rail under such negative pressure.

SUMMARY OF THE INVENTION

The present invention is directed to an improved single hung or double hung plastic or vinyl window assembly and which includes a main frame having a pair of vertical jamb members rigidly connected by a horizontal sill member and a horizontal head member and wherein the sloping sill member of the main frame provides for resisting deflection or bowing of the bottom sash rail of the lower window unit. In accordance with one embodiment of the invention, the sill member of the main frame is extruded with an upwardly projecting and horizontally extending integral rib which is located slightly outwardly from a stop or clip member projecting downwardly from the bottom sash rail of the lower window unit. The stop or clip member overlaps the rib which prevents outward bowing or deflection of the bottom sash rail in response to a substantial negative pressure on the window unit.

Other features and advantages of the invention will be apparent from the following description, the accompanying drawings and the appended claims.

DESCRIPTION OF THE PREFERRED EMBODIMENT

Figure 1:
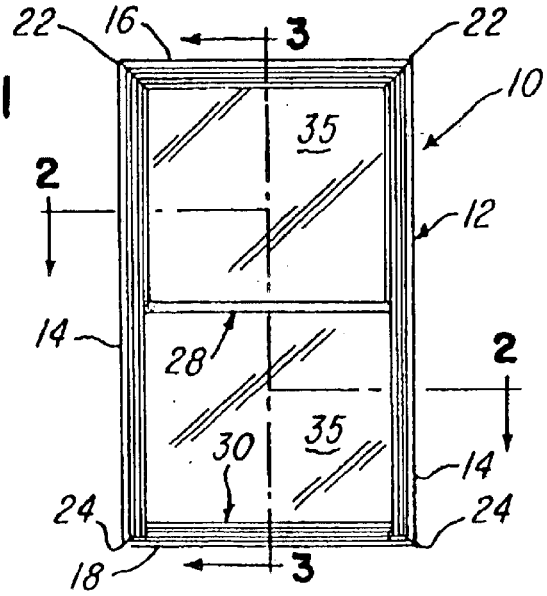
FIG. 1 is an elevational view of a single hung window assembly constructed in accordance with the invention.

FIG. 1 illustrates a single hung window assembly 10 which includes a rectangular window frame 12 formed by a pair of vertical jamb members 14 connected by a horizontal head member 16 and a horizontal sill member 18. The frame members 14, 16 and 18 are formed from extrusions of rigid plastics material such as rigid polyvinylchloride, with the extruded sections having 45° mitered ends rigidly connected by welded mitered upper corner joints 22 and lower corner joints 24. The frame 12 also includes a fixed extruded vinyl horizontal meeting rail or frame member 28 having an internal metal or aluminum reinforcing member 29 rigidly secured to the jamb members 14 by screws (not shown).

The window assembly 10 also includes a sash frame 30 which is fabricated or formed of extruded sections or members 31 and 32 of rigid plastics or vinyl material and having welded mitered corner joints. The sash frame 30 defines a movable window unit 34 and encloses an insulated glazing unit 35 having parallel spaced transparent glass panes 38 bonded together by a resilient bonding material 42 surrounding an aluminum spacer frame 44, in a conventional manner. An extruded plastic removable glazing bead 46 surrounds the glazing unit 35 and secures the glazing unit to the vertical and horizontal members 31 and 32 of the sash frame 30. The horizontal frame member 28 has an upwardly projecting double wall flange 47 and cooperates with a double wall flange 48 on the head member 16 and double wall flanges 48 on the jamb members 14 to receive and support the fixed glazing unit 35 which is retained by surrounding removable glazing beads 46 projecting into grooves within the frame members.

Figure 2:
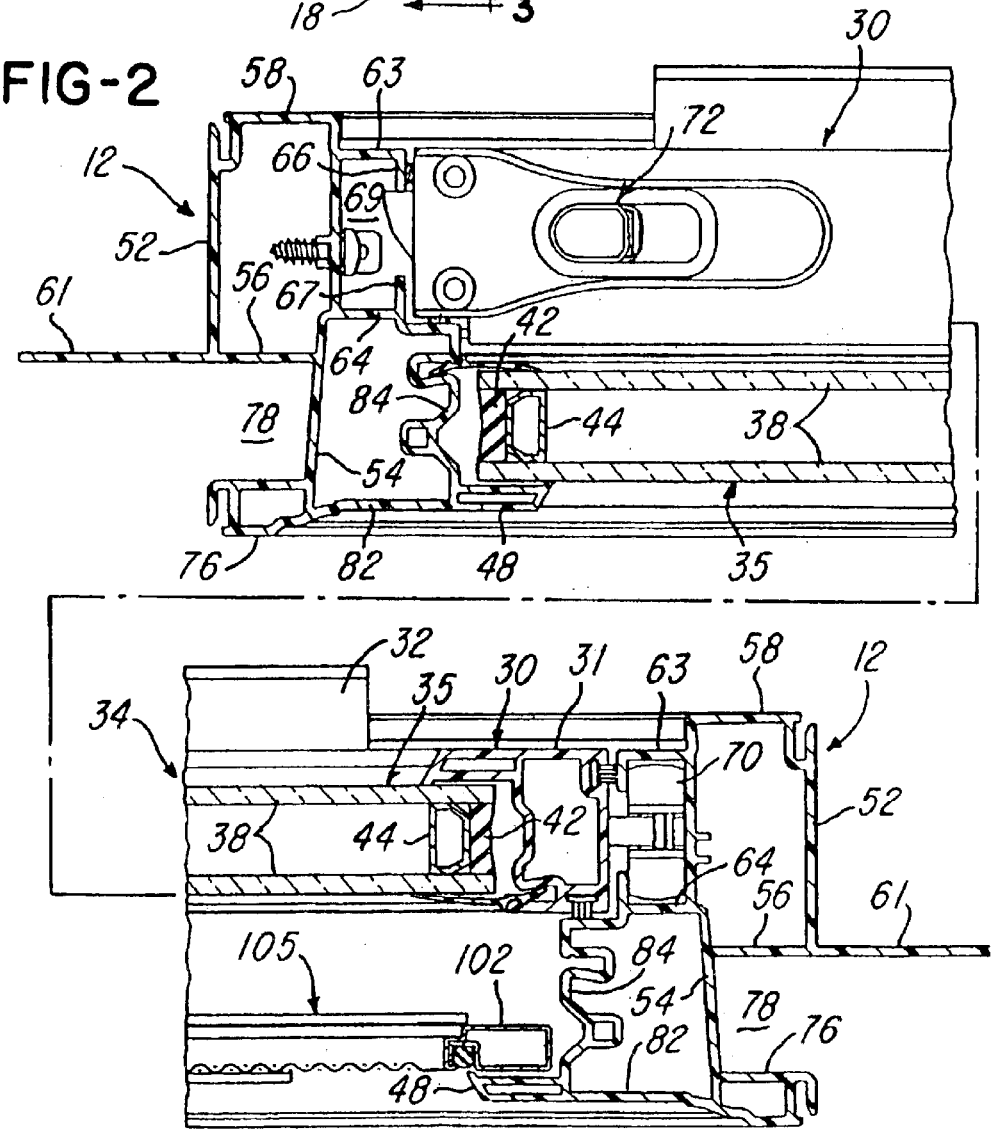
FIG. 2 is a section taken generally on the line 2—2 of FIG. 1 and with a center portion broken away.

Referring to FIG. 2, each of the one-piece jamb members 14 includes an outer wall 52 and a non-parallel inner sloping wall portion 54 which are integrally connected by laterally extending parallel spaced walls 56 and 58. An optional nailing flange 61 projects laterally outwardly from the outer wall 52 as a continuation of the wall 56. Each jamb member 14 also includes inner channel walls 63 and 64 having opposing co-planar flanges or walls 66 and 67 which cooperate to define a chamber or channel 69 for receiving the sliding hardware 70 which supports the sash frame 30 for vertical movement of the window unit 34 between its upper open position and its lower closed position. The channel 69 of each jamb member 12 also receives a retractable latch mechanism 72 which is mounted on the top horizontal frame member or rail 31 of the sash frame 30 and provides for pivoting the window unit 34 relative to the sliding hardware 70 to facilitate cleaning.

As also shown in FIG. 2, the sloping wall 54 of each jamb member 14 projects to the exterior of the wall 56 and integrally connects with a double wall outer flange 76 to define a longitudinally extending chamber or channel 78 adapted to receive the edge portions of exterior decorative siding attached to the wall surface which also receives the nailing flange 61, as disclosed in above-mentioned U.S. Pat. No. 6,055,782, the disclosure of which is herein incorporated by reference. A front wall 82 projects laterally inwardly from the sloping wall 54 and is integrally connected to the channel wall 64 by a contoured wall 84 which extends generally parallel to the outer wall 52. The opposing flanges 48 on the jamb members 14 cooperate with a downwardly projecting double wall flange 86 (FIG. 3) on the frame member 28 to receive a rectangular aluminum frame 102 of a screen assembly 105. The sill member 18 has upwardly projecting spaced ribs 106 to receive therebetween the lower end or rail of the screen frame 102.

Figure 3:
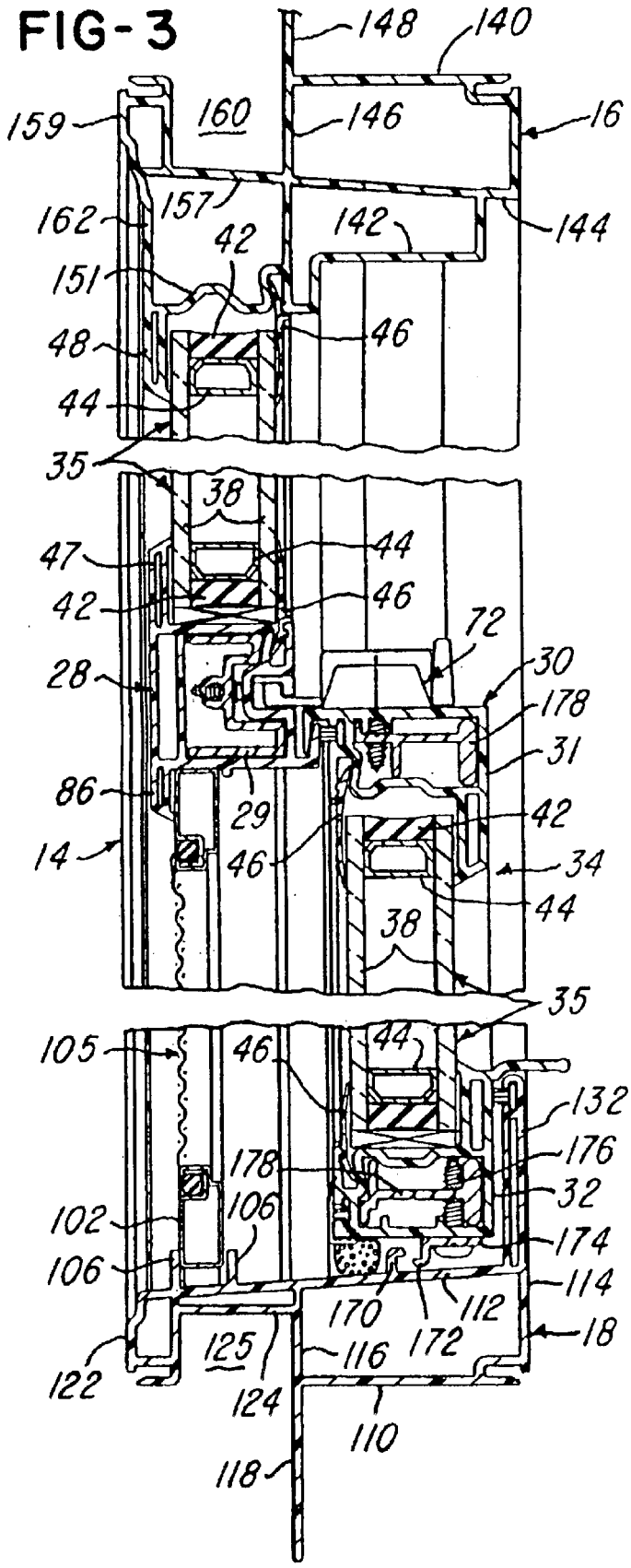
FIG. 3 is a vertical section of the window assembly taken generally on the line 3—3 of FIG. 1 and with upper and lower portions of the assembly broken away.

As also shown in FIG. 3, the one-piece sill member 18 of rigid plastics or vinyl material includes an outer wall 110 which seats within a rough window opening (not shown), and the wall 110 is integrally connected to an inner sloping top sill wall 112 by laterally extending parallel spaced walls 114 and 116. An optional nailing flange 118 projects laterally outwardly from the outerwall 110 and forms an extension of the wall 116. The sloping top wall 112 extends outwardly from the exterior of the nailing flange 118 to a double wall flange 122. The wall 112 is reinforced by a wall 124 which cooperates with the wall 116 and flange 122 to define a longitudinally extending recess or channel 125 for receiving the edge portions of exterior decorative siding in the same manner as described above for the channel 78. The sill member 18 also includes an interior double wall flange 132 which projects upwardly and overlies the bottom rail 32 of the sash frame 30.

The one-piece head member 16 of the window frame 12 includes and outer wall 140 and a laterally inwardly parallel spaced wall 142 integrally connected by a stepped inside wall 144 and an outside wall 146. An optional nailing flange 148 projects laterally upwardly from the outer wall 140 in alignment with the wall 146, and the walls 142 and 146 are integrally connected to the flange 48 by a contoured wall 151. A sloping wall 157 continues outwardly to the exterior from the wall 146 and integrally connects with a double wall flange 159 to define a channel 160 forming a continuation of the channels 78 and 125 to complete the channel around the frame 12. The flange 159 is integrally connected to the wall 151 by a front outer wall 162.

In accordance with the present invention, the inner sloping wall 112 of the sill member 18 includes an upwardly projecting stop member or integrally extruded rib 170 which has a tip projecting inwardly to form a hook-shaped cross-sectional configuration. The rib 170 extends the full length of the sill member 18 between the jamb members 14. The bottom rail member 32 of the sash frame 30 has a stop member or rib 172 which projects downwardly and outwardly in laterally opposing and slightly spaced relation to the stop member or rib 170. As shown, the stop member or rib 172 is formed by an L-shaped clip member 174 which has a length of approximately two inches. The clip member 174 is secured to the bottom surface of the sash rail 32 in the center portion or at the midpoint by a pair of screws 176 which extend upwardly into the sash rail 32 and are threaded into a metal or aluminum reinforcing member 178 confined within the hollow portion of the rail 32. However, it is within the scope of the invention to extrude the stop member or rib 172 as an integral part of the bottom rail 32 of the sash frame 30.

As apparent from FIG. 3, if the window unit 34 or the assembly of the sash frame 30 and enclosed glazing unit 35 is exposed to a substantial outside negative atmospheric pressure, the bottom sash member or rail 32 will deflect or bow slightly until the stop member or rib 172 engages or hooks onto the rib 170 which limits any further deflection or bowing of the bottom sash rail 32. As a result, the sash frame 30 and glazing unit 35 is prevented from being damaged or broken. It is also apparent that the rib 170 and stop member 172 may be used to limit deflection of the bottom sash rail of the lower window unit of a double hung window assembly. The rib 170 and stop or clip member 172 also contribute to minimizing the metal reinforcement members within the sash rails and to minimizing the wall thickness of the sash frame extrusions.

While the form of window assembly herein described constitutes a preferred embodiment of the invention, it is to be understood that the invention is not limited to this precise form of window assembly, and that changes may be made therein without departing from the scope and spirit of the invention as defined in the appended claims.

What is claimed is:

1. A window assembly comprising a main frame including a pair of vertical jamb members rigidly connected by a horizontal sill member and a horizontal head member, all of said members comprising extrusions of rigid plastics material with each member having an outer wall adapted to fit within a rough window opening and integrally connected to a laterally spaced inner wall, said jamb members having inner channel walls projecting laterally inwardly of the corresponding said inner wall and defining guide channels, at least one window unit including a sash frame enclosing a glazing unit and supported by hardware within said guide channels for vertical movement between an open position and a closed position, said inner wall of said sill member sloping downwardly and outwardly towards an exterior portion of said window assembly, said inner wall of said sill member having an upwardly projecting hook-shaped first stop member extending between said jamb members under said sash frame, said sash frame including a lower sash rail having a downwardly projecting hook-shaped second stop member inwardly overlapping and opposing said first stop member on said sill member when said window unit is in said closed position, and said downwardly projecting second stop member is rigidly connected to said lower sash rail and is effective to hook said first stop member in response to a substantial outside negative atmospheric pressure on said window assembly to limit bowing of said lower sash rail and said window unit.

2. A window assembly as defined in claim 1 wherein said second stop member comprises a metal clip having a downwardly projecting stop portion and a horizontal flange portion rigidly attached to said lower sash rail.

3. A window assembly as defined in claim 1 wherein said lower sash rail encloses an elongated internal metal reinforcing member, and a threaded fastener connects said second stop member to said lower sash rail and said reinforcing member.

4. A window assembly as defined in claim 1 wherein said second stop member comprises a rigid clip rigidly attached to said lower sash rail and to a rigid reinforcement member within said lower sash rail.

5. A window assembly, comprising a main frame including a pair of vertical jamb members rigidly connected by a horizontal sill member and a horizontal head member, all of said members comprising extrusions of rigid plastics material with each member having an outer wall adapted to fit within a rough window opening and integrally connected to a laterally spaced inner wall, said jamb members having inner channel walls projecting laterally inwardly of the corresponding said inner wall and defining guide channels, at least one window unit including a sash frame enclosing a glazing unit and supported by hardware within said guide channels for vertical movement between an open position and a closed position, said inner wall of said sill member sloping downwardly and outwardly towards an exterior portion of said window assembly and having an upwardly projecting integral rib extending between said jamb members under said sash frame, said sash frame including a lower sash rail having a downwardly projecting rigid stop member inwardly overlapping and opposing said rib on said sill member when said window unit is in said closed position, said lower sash rail encloses an elongated internal metal reinforcing member, and a threaded fastener connects said stop member to said lower sash rail and said reinforcing member to limit bowing of said lower sash rail and said window unit in response to a substantial outside negative atmospheric pressure on said window assembly.

6. A window assembly as defined in claim 5 wherein said stop member comprises an elongated rib within a center portion of said lower sash rail and extending parallel to said rib on said sill member.

7. A window assembly as defined in claim 5 wherein said stop member comprises a clip attached to said lower sash rail.

8. A window assembly as defined in claim 5 wherein said rib on said sill member extends to each of said jamb members.

9. A window assembly as defined in claim 5 wherein said rib has a generally hook-shaped cross-sectional configuration.

10. A window assembly as defined in claim 5 wherein said stop member comprises a metal clip having a downwardly projecting stop portion and a horizontal flange portion attached to said lower sash rail.

11. A window assembly, comprising a main frame including a pair of vertical jamb members rigidly connected by a horizontal sill member and a horizontal head member, all of said members comprising extrusions of rigid plastics material with each member having an outer wall adapted to fit within a rough window opening and integrally connected to a laterally spaced inner wall, said jamb members having inner channel walls projecting laterally inwardly of the corresponding said innerwall and defining guide channels, at least one window unit including a sash frame enclosing a glazing unit and supported by hardware within said guide channels for vertical movement between an open position and a closed position, said inner wall of said sill member sloping downwardly and outwardly towards an exterior portion of said window assembly and having an upwardly projecting integral rib extending to said jamb members under said sash frame, said sash frame including a lower sash rail, a clip member mounted on said sash rail and projecting downwardly in inwardly overlapping relation to said rib on said sill member when said window unit is in said closed position, said lower sash rail enclosing an elongated internal rigid reinforcing member, and a fastener rigidly connects said clip member to said lower sash rail and said reinforcing member to limit bowing of said lower sash rail and said window unit in response to a substantial outside negative atmospheric pressure on said window assembly.

12. A window assembly as defined in claim 11 wherein said clip member is located on a center portion of said lower sash rail.

13. A window assembly as defined in claim 11 wherein said rib and said clip member each has a generally hook-shaped cross-sectional configuration.

* * * * *